US006733630B1

(12) United States Patent
Rantanen et al.

(10) Patent No.: US 6,733,630 B1
(45) Date of Patent: May 11, 2004

(54) METHOD AND APPARATUS FOR SUPPORTING A PAPER AND BOARD WEB IN FINISHING EQUIPMENT

(75) Inventors: Rauno Rantanen, Karlstad (SE); Juha Lipponen, Kerava (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 09/869,752

(22) PCT Filed: Jan. 5, 2000

(86) PCT No.: PCT/FI00/00008

§ 371 (c)(1),
(2), (4) Date: Jul. 31, 2001

(87) PCT Pub. No.: WO00/40799

PCT Pub. Date: Jul. 13, 2000

(30) Foreign Application Priority Data

Jan. 5, 1999 (FI) ..... 990008

(51) Int. Cl.[7] ..... D21H 23/26

(52) U.S. Cl. ..... 162/204; 162/135; 162/266; 162/184; 427/391; 118/643; 226/91

(58) Field of Search ..... 162/135–137, 162/204–207, 265–266, 184–201; 118/60, 62, 67, 641–643, 58, 239, 250, 249; 427/356, 372.2, 541–542, 355, 365, 402, 428; 34/421, 422, 454, 465, 623

(56) References Cited

U.S. PATENT DOCUMENTS

| | | | | | |
|---|---|---|---|---|---|
| 5,547,509 | A | * | 8/1996 | Neider et al. | 118/68 |
| 5,717,215 | A | * | 2/1998 | Inushima et al. | 250/372 |
| 6,103,314 | A | * | 8/2000 | Kinnunen | 427/428 |
| 6,119,362 | A | * | 9/2000 | Sundqvist | 34/120 |
| 6,368,459 | B1 | * | 4/2002 | Kinnunen | 162/207 |
| 6,399,160 | B1 | * | 6/2002 | Gron et al. | 427/542 |
| 6,440,271 | B1 | * | 8/2002 | Heikkinen et al. | 162/207 |
| 2001/0008181 | A1 | * | 7/2001 | Anderson | 162/204 |

FOREIGN PATENT DOCUMENTS

| | | | | |
|---|---|---|---|---|
| CA | 2151287 | | 12/1995 | |
| DE | 44 20 242 | A1 | 1/1995 | B05C/1/00 |
| WO | WO 9514816 | A1 * | 6/1995 | D21H/23/70 |
| WO | 99/45203 | * | 9/1999 | |

* cited by examiner

*Primary Examiner*—Jose A. Fortuna
(74) *Attorney, Agent, or Firm*—Cohen, Pontani, Lieberman & Pavane

(57) ABSTRACT

Method and assembly for supporting a web (1) during the postprocessing of a web of paper or board, in which method the web is passed from a preceding device to at least one next downstream located web treatment device (4) wherein to at least one side of the web (1) is applied a treatment agent causing wetting of said side of said web, and the web (1) exiting said web treatment device is passed to at least one dryer means (8). The web (1) is contactingly supported in a continuous and unbroken manner at least from said web treatment device (4) to said dryer means (8). Advantageously, the web (1) is dried by means of at least one dryer (3) before taking the web to the web treatment device (4), and the web is contactingly supported in a continuous and unbroken manner at least from said dryer means (3) preceding said web treatment device (4) to said dryer means (8) located downstream next to said web treatment device.

82 Claims, 3 Drawing Sheets

METHOD AND APPARATUS FOR SUPPORTING A PAPER AND BOARD WEB IN FINISHING EQUIPMENT

PRIORITY CLAIM

This is a national stage of PCT application No. PCT/FI00/00008, filed on Jan. 5, 2000. Priority is claimed on that application and on patent application No. 990008 filed in Finland on Jan. 5, 1999.

FIELD OF THE INVENTION

The invention relates to a method and apparatus for supporting and passing webs such as paper and board webs in a contacting manner in a paper/board machine in which the base web forming section is immediately followed by web finishing devices for immediate treatment of a web leaving the base web forming section.

BACKGROUND OF THE INVENTION

With the increasing demands on higher web speeds and quality, well-behaved supporting and drying of a running web are becoming increasingly important in paper and board manufacture. Therefore, it is desirable to pass the web in a continuously or at least partly supported manner over a maximally long total distance of its travel in the web finishing sections. The technique used for web support also affects the drying process of the web. As web breaks occur more easily in a wet web than in a dry web, unsupported passages of the wet web over the distance from one support member to the next, before the wetted web is dried, represent potential points of web breaks. If the web can be supported in a contacting manner as long as the web is wet, the number of web breaks can be reduced. Simultaneously, the coating of the web may also be carried out at a higher moisture content and thus in a state of weaker tensional strength than has been possible in the prior art. As a result of processing the web at said higher moisture content, substantial savings can be attained in regard to both the overall energy consumption and investment costs of the dryer equipment. Further, as the specific drying capacity required in the different process steps for obtaining sufficient strength qualities of the web is not set any more, the moisture content of the web can be kept optimal with respect to the desired end product qualities throughout the manufacturing process.

In U.S. Pat. No. 5,547,509 is described an apparatus for supporting a paper web during the application step when the web is passed through the coating and doctoring installation. In this embodiment, the coating applicator may be, e.g., an application roll and the web is passed onto a support belt before it enters the nip of the applicator and, after application, is passed in a supported manner to the dryers. The function of the support belt is to reduce the number of web breaks in application and doctoring as well as along the web passage from the doctor blade to the dryers. The dryers are of the non-contacting type and the web is supported over its passage between the dryers by means of small-diameter support rolls. The supported portion of web travel covers the applicators only. Before entering the applicator and during drying, the web runs unsupported. Furthermore, as the application takes place using an applicator roll, the entry of the web to the applicator roll is very complicated, because the applicator roll (kissing roll) of a roll applicator must be arranged to rotate in a coating mix pan, which necessarily requires the applicator roll to be the lower roll in the roll nip and, as a result, the coated side of the web to be the underside of the web entering the applicator nip. obviously, passing the web to one applicator is simple along a straight path, but as the web is conventionally coated on both sides, reversing the web travel for coating the opposed side requires a complicated guide roll set in which the web cannot be supported by any practicable means using a support wire or belt.

In German patent publication no. 44 20242 is described an application method in which the web is coated in a film-transfer coater and then passed over the backing roll to a drying cylinder. Operating in conjunction with the backing roll, there is arranged an unrestrained type of dryer and from the backing roll the web is passed to a wire-supported dryer cylinder. While the wire in this embodiment is supportedly passed through the dryer cylinder section, the most critical passage with respect to web breakages, that is, the web travel within the area of the applicator and the first dryer unit, is passed only supported at the support rolls. Since the web has no continuous support when it is wet and hence has the lowest strength, this kind of web supporting offers no substantial contribution to web runnability and lesser number of web breaks.

SUMMARY OF THE INVENTION

It is an object of the present invention to provide a method and apparatus for implementing a fully-supported travel of a web running on a wire or belt through the coating applicator and also, at least partially supported, during subsequent drying.

The goal of the invention is achieved by passing the web to a coater station or other web treatment device in which the web will be wetted and, further, to at least the first dryer located next downstream to the coater in a continuously contactingly supported manner.

According to a preferred embodiment of the invention, the web is passed in a continuously contactingly supported manner from a dryer preceding a coater to a dryer located next to the coater in the downstream direction of web travel.

According to an embodiment of the invention, the web is passed from a dryer preceding the coater to a dryer located next to a coater in the web downstream travel direction with the help of a single continuous support means.

According to an embodiment of the invention, the web is passed to at least one coater with the help of the support means of the upstream preceding web treatment device.

According to the most preferred embodiment of the invention, the web is passed to a coater from the upstream preceding web treatment device in a supported manner and only partially dried.

The invention offers significant benefits.

Continuous belt or wire support can effectively reduce the number of web breaks occurring in the manufacture of paper grades having a low basis weight. Additionally, the support embodiment according to the present invention based on belt-supported web travel permits the web to be passed to a coater only partially dried, because this arrangement eliminates the risk of breaks in a wet web. In this context, the term partially dried web must be understood to refer to a web having a moisture content essentially higher than that of the finished end product. In this manner, the drying process of the base web and its coating in the manufacture of a paper/board grade can be optimized so as to achieve a maximally high quality of the finished end product. As a result, the coating process can be carried out at the optimum moisture content with respect to the desired qualities of the coated paper/board product, specific energy consumption and the drying requirements of the base web and its coating, as well as with respect to the investment cost of drying capacity and the overall efficiency of the manufacturing process. By contrast, in prior-art embodiments it has been mandatory to pass the base web in a rather dry state into the coater in order to avoid web breaks. In practice, this has required the moisture content of the base web leaving the papermaking machine to be substantially equal to that of the finished end product.

Other objects and features of the present invention will become apparent from the following detailed description considered in conjunction with the accompanying drawings. It is to be understood, however, that the drawings are intended solely for purposes of illustration and not as a definition of the limits of the invention, for which reference should be made to the appended claims.

BRIEF DESCRIPTION OF THE DRAWINGS

In the following the invention will be examined in greater detail with the help of the appended drawings in which.

DETAILED DESCRIPTION OF THE PRESENTLY PREFERRED EMBODIMENTS

It must be noted that the term coater in the context of the present invention is used in a broad sense including also size presses and other web treatment equipment in which a material is applied to the surface of a web in a manner causing an increase of moisture content in the web.

Figure 1:
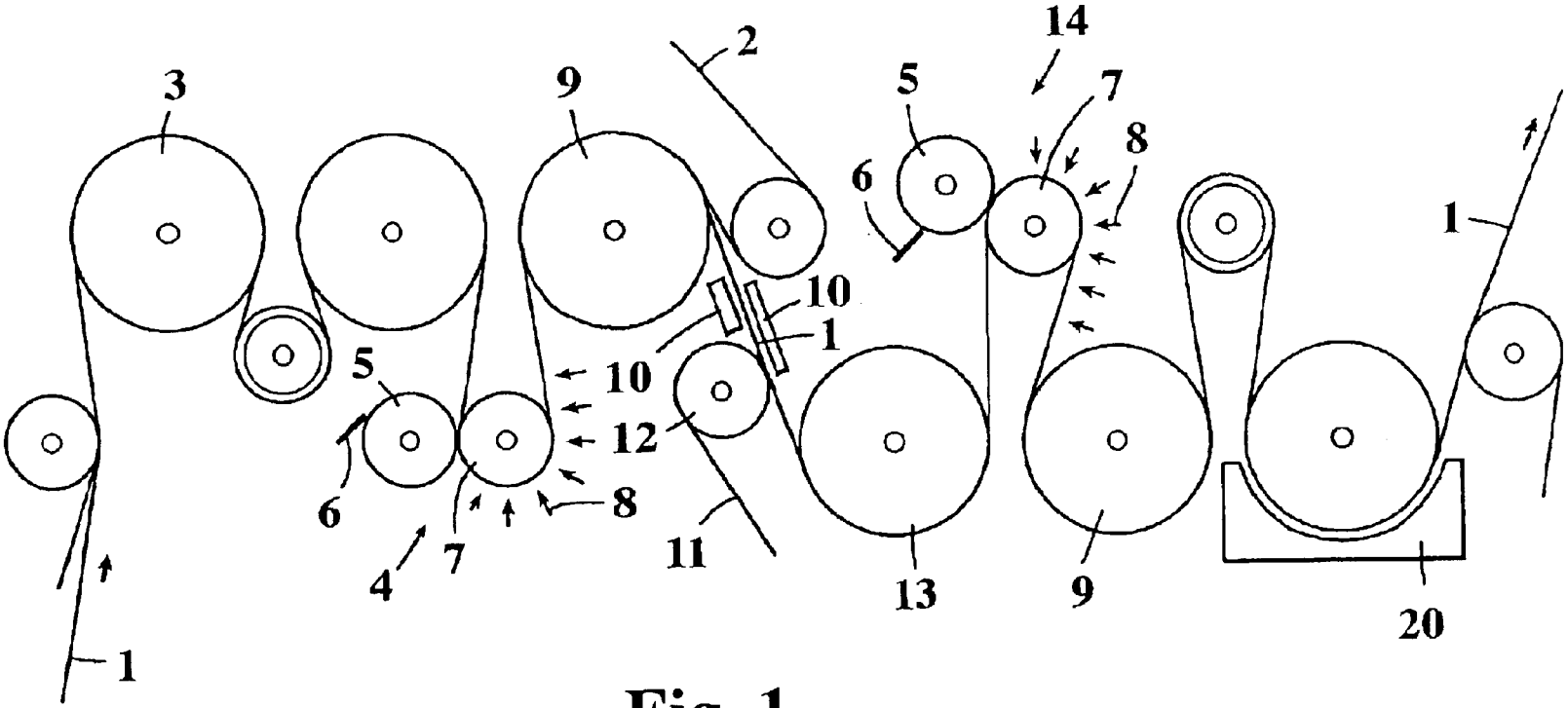
FIG. 1 shows diagrammatically a first coater/dryer arrangement according to the invention.

Referring to FIG. 1, a web 1 in the arrangement illustrated therein is passed to the applicator section of a coater directly from a forming section supported by a dryer wire 2 of the papermaking machine. Obviously, the same arrangement may also be used in conjunction with a board making machine. At the end of the dryer section of the papermaking machine, the web 1 passes supported by a wire 2 over dryer cylinders 3, whereby the moisture content of the web 1 exiting from the papermaking machine is controlled to a desired value at these cylinders. When leaving these last dryer cylinders 3, the web is passed supported by the wire 2 of the dryer section of the papermaking machine to a first applicator station 4. The applicator is a film-transfer coater in which the coating mix is first applied by an applicator apparatus 6 onto the surface of a film-transfer roll 5 and then in a nip formed between the film-transfer roll 5 and a backing roll 7 to the surface of the web being coated. The web 1 and the dryer wire 2 pass over the backing roll 7.

Operating in conjunction with the backing roll 7, there is disposed a noncontacting dryer 8 denoted by arrows pointed toward the web in the diagram. The noncontacting dryer can be implemented as an air or steam dryer, IR dryer, microwave dryer or other suitable type of noncontacting dryer. Most advantageously, the noncontacting dryer 8 is an impingement air dryer adapted to operate with air jets directed partially against the backing roll 7 of the film-transfer coater and partially against the dryer wire 2 over the length of the continuous wire supporting the web after leaving the backing roll. This arrangement provides a long drying travel in a noncontacting manner, simultaneously keeping the overall length of the wire loop and the travel length of the wire as short as possible. Still supported by the drying wire 2, the wire is passed from the backing roll 7 in the downstream direction to a first postdryer cylinder 9, where the coated side of the web 1 wraps the dryer cylinder 9 when pressed by the wire 2 against the surface of the cylinder 9. The surface of the dryer cylinder 9 may be surfaced with an antistick coating such as Teflon® (PTFE) or, more advantageously, a pressurized dryer cylinder is used at which air or superheated steam is blown from within the cylinder against the web thus lowering the surface pressure of the web against the cylinder or even forcing the web off from the cylinder surface into a noncontacting floating position. The cylinder 9 in the present context must be understood to refer in a general sense to any part of a dryer cylinder group. Obviously, different types of dryer cylinder elements can be used in a dryer section in lieu of the one illustrated herein when varied embodiments of the invention are to be implemented.

At this stage, the web need not necessarily be dried to its final moisture content. The dryer wire 2 of the papermaking machine is passed from the first postdryer cylinder 9 over a guide roll to the return leg of the wire back toward the direction of the papermaking machine.

The web 1 being processed now leaves the dryer wire 2 and passes onto a second wire 11 that runs over a guide roll 12 as to transfer and support the web in the following web treatment device. Over the distance from the postdryer cylinder 9 to the guide roll 12 of the second wire 11, the web 1 travels without support by a wire. However, the web can be passed over such a short distance unsupportedly inasmuch the web is not subjected to any stressing treatment and the web is relatively dry, whereby it is most tolerant to a possible tensional stress due to variations in web draw. This open passage of web travel can be utilized for measuring various qualities of the paper using a measurement beam sensing the sheet from both sides. However, it is also possible to pass the web if so required directly in a supported manner from the dryer wire 2 to the next dryer wire 11 using any conventional supporting means 10.

The second wire 11 passes the web 1 to a dryer cylinder 13, where the web travels in a nip between the dryer cylinder 13 and the wire having the coated side of the web facing the wire 11, which requires the sheet-facing side of the wire to be sufficiently smooth. Alternatively, the cylinder 11 may be any cylinder of a dryer section or a web lead roll or draw roll or a set of such rolls. Supported web travel permits the drying process of the sheet to be controlled during the different treatment steps of the web 1 so that the drying and wetting of the base sheet during application takes place in an optimal manner and the penetration of water from the coating mix into the base sheet can be controlled.

From the predryer cylinder 13, the web is passed to a backing roll 7 of a second coater station 14. At this stage, the web 1 and the second wire 11 travel so that the wire passes through the nip between the web and the backing roll 7 and, simultaneously, the applicator roll 5 rests against the web 1, whereby it applies a coat layer to the uncoated side of the web 1. Next, the web is passed supported by the second wire 11 via a noncontacting dryer section to the first postdryer cylinder 9, where the coated side of the web wraps the cylinder surface. In this web treatment step, the contacting dryer is an inverted dryer cylinder group. With the help of the inverted group, the web can be passed from the upper, leaving group to the lower, receiving group and vice versa as is the case when the supported and treated sides of the web are to be reversed, e.g., for coating the opposed side of the web. In this embodiment, also the predryer cylinder 13 is disposed in a position corresponding to that of the inverted roll group, because the cylinder is the first dryer member to receive the web.

Figure 2:
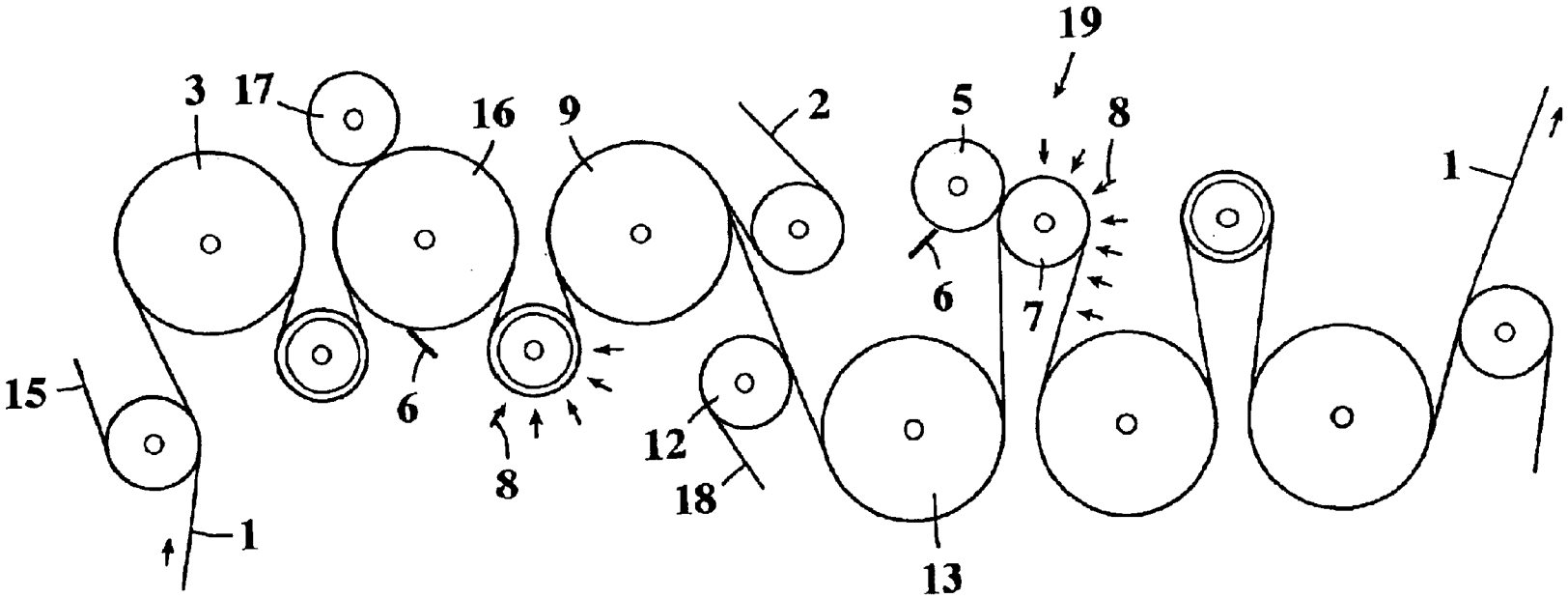
FIG. 2 shows diagrammatically a second coater/dryer arrangement according to the invention.

In FIG. 2 is shown an alternative embodiment of the invention in which the web 1 leaving, e.g., the second coater station and its inverted roll group is passed to the next coating step and, simultaneously, the supported side of the web 1 is reversed, whereby the web is passed to run on a third wire 15. It must be noted that the web may as well be received from the wire of the papermaking machine. In the case that the wire is received from the first coater station, its both sides are already coated once, whereby the embodiment of FIG. 2 is used for applying a second coat layer. Therefore, the new layer of coating is applied in this embodiment to the first side of the web in a manner slightly different from that described above for the preceding coater stations 4, 14. Herein, the applicator roll 16 is a large-diameter cylinder having dimensions approximately equal to those of the dryer cylinders and the web wraps this cylinder 16 under the loading pressure imposed by said third wire 15. The coating is metered on the applicator roll 16 by means of an applicator apparatus 6 located under the applicator roll, whereby the coat can be transferred to the web 1 during the long dwell time of the web on the cylinder surface. The application pressure is imposed by means of said third wire 15 and if so required, the loading pressure may be increased with the help of a press roll 17 or a sliding shoe pressing the wire 15 and the underlying web 1 against the applicator roll 16. From the applicator roll 16, the web 1 passes about a guide roll having a noncontacting dryer 8 adapted to cooperate therewith. Next to the noncontacting dryer is disposed a postdryer cylinder 9, wherefrom web travels over an unsupported passage to a fourth wire 18 and a fourth coater station 19. Herein, the path and coating operations of the web are equivalent to those of the first coating step carried out on the second side of the web. After the application of the second coat layer to the second side of the web, the web is dried to its final moisture content and passed to an winder or, alternatively, the web can be passed to a calender, whereby the moisture content of the web must be controlled to a proper level for calendering.

To remove excess moisture from the web, the dryer cylinders may be complemented with air-impingement or suction hoods 20. The web support can be implemented with the help of various kinds of belt or wire elements. A basic requirement is that the structure and material of the elastic, continuous support element is compatible with the handling of the product being manufactured. In board manufacture, the wire may even have a coarse texture, while paper grades of high basis weight require a fine-weave wire and a low-weight paper grade must be supported using an extremely fine-weave wire, support belt or even a support band of substantially nonpermeable, smooth material. In principle, the lower the basis weight of the product the smoother the support element must be in order to avoid marks in the supported web. Respectively, the film-transfer roll of the applicator apparatus should preferably be of a soft-surfaced type, advantageously having a hardness in the range of 20–100 P&J when the film-transfer technique is being used for coating application.

Figure 3:
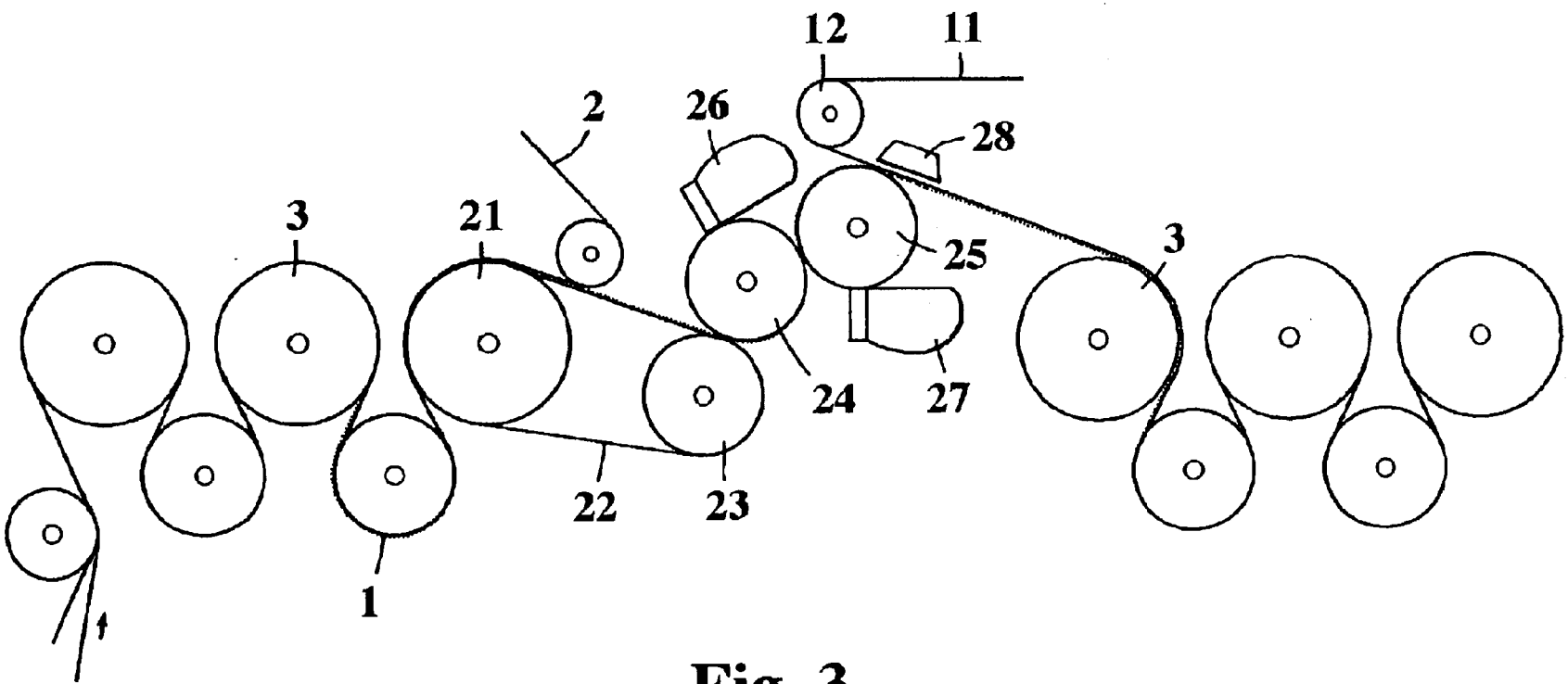
FIG. 3 shows a preferred coater arrangement utilizing an embodiment according to the invention.

In FIG. 3 is shown an embodiment according to the invention for a fully-supported web travel through a film-transfer coater. In this arrangement, both sides of the web 1 are treated at the same coater station. This embodiment is particularly suited to surface sizing, wherein the surface smoothness of support elements and cylinders are not decisive to the surface quality as in the actual coating application. The arrangement is fully free from unsupported web passages and the web is supported throughout the web treatment process by a roll or a support element. Supported by the papermaking machine wire 2, the web enters the film-transfer coater from, e.g., the dryer cylinder group of the papermaking machine over dryer cylinders 3 and turning rolls. After the last dryer cylinder, the wire 2 is arranged to pass around a cross-over roll 21. The cross-over roll 21 is wrapped by a cross-over support belt or wire 22 that also runs around a turning roll 23, whereby the web 1 is picked up at the cross-over roll between the papermaking machine wire 2 and the cross-over support wire 22. At the separation point of the wires 2 and 22, the cross-over support wire has been arranged to pick up the web 2 by means of a suction box adapted behind the cross-over support wire 22 or by selecting the wire materials and weave smoothnesses properly or by using a smooth transfer belt to which a dry web adheres with the help of static electricity or a wet web adheres due to adhesion forces which are stronger toward a smooth-surfaced belt than a permeable wire. The use of a smooth-surfaced belt is particularly advantageous in the above-described embodiment in which the web will not be dried to its final moisture content prior to its surface sizing or coating application. Furthermore, this arrangement requires less space than constructions. performing web transfer from one support wire to another by means of a suction box.

From the support wire 2, the web is transferred to a first applicator roll 24 having a first applicator apparatus 26 adapted to cooperate therewith so as to apply a surface size, coating or other web treatment agent to the surface of the roll 24. Since the outer perimeter of the applicator roll 26 is wet due to the treatment agent metered thereon, the web 1 meeting the roll 24 readily adheres to the roll surface. Next, the web adhering to the surface of the first applicator roll 24 passes into the nip formed between the applicator rolls 24, 25, wherein it is transferred to wrap the surface of the second applicator roll 25. A second applicator apparatus 27 is used to apply the web treatment agent to the surface of the second applicator roll. As the web 1 has been wrapping the perimeter of the first applicator roll by half a turn, it tends to continue its adherence to the roll surface. Hence, the surface properties of the first and the second applicator roll must be selected so that the web 1 has a greater preference to leave the nip by adhering to the surface of the second applicator roll 25. As the surfaces of both applicator rolls are wetted by the web treatment agent, the web separates more readily if the supporting surface has a coarser structure provided by a more hydrophilic material or, alternatively, the surface is made harder. Toward this end, the surface of the second applicator roll may be surfaced with a smooth, hydrophobic coating such as Teflon® (PTFE), whereby the surface of the first applicator roll is surfaced with another material of a coarser structure, such as rubber.

Over the surface of the second applicator roll 25 is adapted to run a dryer group wire 11 that is passed to the applicator roll over a turning roll 12. At this stage, an air-permeable wire or felt is advantageously used as the web support element, since this arrangement permits the web 1 to be easily transferred by means a suction box 28 adapted to the point where the wire 12 leaves the second applicator roll 25 to adhere to the wire 11. Next, the web passes supported by the wire 11 to a conventional dryer cylinder group, where the wire 11 presses the web against the surface of the dryer cylinders. In surface sizing, the web 1 can be passed directly to the dryer cylinders 3, and both sides of the web can be treated in the above-described manner simultaneously.

The method taught above for transferring a web from one support element to another by virtue of utilizing the differences in the adherence properties of the support elements may be advantageously employed in the arrangements illustrated in FIGS. 1 and 2, as well as any other embodiments covered by the scope and spirit of the invention.

In addition to those described above, the present invention may have alternative embodiments.

Web moisture content in the various web treatment steps can be adjusted optimal to achieve the desired end result of the coating application or web treatment process, because there is no more any need to dry the web between the treatment steps below the optimum moisture content of the process in order to achieve better runnability over the unsupported passages. As a fully supported web can be handled even when wet and unsupported passages are eliminated from the travel of the wet web, the web needs drying only so much as is necessary to pass the web supportedly through the next application step and to achieve, e.g., an optimal coat surface quality, coat weight or minimized specific energy consumption in drying. In this manner, the web treatment steps can be carried out at their optimal points of the papermaking process in regard to web moisture content, e.g., to manufacture a given paper grade, to eliminate web breakage for some paper grade or implement an energy management system of the process or to control some other kind of process variable.

Web support can be implemented using a continuous movable element which may be, e.g., a metal, polymer, glass fiber or carbon fiber belt, wire, felt or web or band. As discussed above, the surface properties of support element have a decisive role in the transfer of the web from one support element to another, which means that the permeability properties of the support element surfaces must be optimized so as to eliminate all separate web tail threading or support means from the web transfer and threading system. The selection of the suitable support element type is also dependent on the dryer equipment used, whereby air-impingement and suction dryers conventionally require a gas-permeable support element for proper function, while infrared dryers and the like need the support element to be only resistant to the heat load imposed by the dryer.

The web support method according to the invention may also be used in combination with noncontacting web support arrangements so that the web is passed supported by air jets to a section utilizing the support system according to the invention or, respectively, is passed from the process line section utilizing the support system according to the invention to the next downstream located web treatment section, where the web is guided by means of an air-jet support system. The number of dryer cylinders before and after the web treatment section discussed herein may be varied as needed and the desired sections of the web processing line may be implemented using two-wire support in which the web is supported from both sides.

The web support elements may be grouped in many different fashions. In addition to those described above, the web may be guided so that a single continuous support element is used to pass the web from the first web treatment device all the way down to the next web treatment device. The application nip or area may be formed by pressing the support belt either directly against the web by means of the belt-tensioning force or by augmenting the loading pressure with a separate press roll or sliding shoe. When the web is passed from one support element to another, it can be passed via wire/web spreading means.

Although the metering of the coating film in the above-described embodiments illustrating the use of a film-transfer coater mention is made on the surface of an applicator roll, the coating film may as well be applied via a single belt in single-sided coating application and, in two-sided coating application, via two belts or one belt combined with an applicator roll. Accordingly, the invention is not limited to the use unrestrained drying, but instead, the web may be passed supported according to the invention directly to a dryer cylinder in a contacting manner unless other technical details of the process are contradictory to this.

Web support can be implemented over the distance from a hood-covered coater to a downstream located dryer so that the web postprocessing steps or the runnability and/or environmental aspects of the papermaking machine are taken into account with regard to good operability, control and maintenance. The hood can be divided into compartments, whereby the above-mentioned requirements are easier to meet by compartment. Web drying may also be carried out using two-sided drying. Herein, a metallic or heat-resistant polymer material belt can be used.

The methods according to the invention may be complemented with coat weight measurement means when the web travels supported on a belt or wire. Obviously, this excludes the use of two-sidedly located measurement equipment. A suitable gaging technique of, e.g., solids in the base sheet and coat weight for $CaCO_3$-based pigments is the x-ray fluorescence method. The x-ray fluorescence technique may be complemented with any conventional sheet basis weight and moisture content measurement means, whereby a plurality of sheet quality factors can be computed from the measurement data.

Thus, while there have been shown and described and pointed out fundamental novel features of the present invention as applied to preferred embodiments thereof, it will be understood that various omissions and substitutions and changes in the form and details of the devices described and illustrated, and in their operation, and of the methods described may be made by those skilled in the art without departing from the spirit of the present invention. For example, it is expressly intended that all combinations of those elements and/or method steps which perform substantially the same function in substantially the same way to achieve the same results are within the scope of the invention. Substitutions of elements from one described embodiment to another are also fully intended and contemplated. It is also to be understood that the drawings are not necessarily drawn to scale but that they are merely conceptual in nature. It is the intention, therefore, to be limited only as indicated by the scope of the claims appended hereto.

What is claimed is:

1. A method for supporting a web during the post-processing of a web of paper or board, the method comprising the steps of:

passing the web from a preceding section to at least one next downstream located web treatment section wherein to at least one side of the web is applied a treatment agent causing wetting of said side of said web;

passing the web exiting said web treatment section to at least one dryer apparatus; and supporting the web contactingly in a continuous and unbroken manner by a single supporting element at least through and from said web treatment section to said dryer.

2. The method of claim 1, further comprising:

drying the web with at least one drying apparatus prior to passing the web to said web treatment section; and contactingly supporting the web in a continuous and unbroken manner at least from said drying apparatus preceding said web treatment section to said dryer apparatus located downstream next to said web treatment section.

3. The method of claim 2, wherein the the supporting element is a dryer wire of a paper- or board making machine.

4. The method of claim 3, wherein the web is passed supported by a continuous support element at least from a drying apparatus preceding said web treatment section to the drying apparatus located downstream next to said web treatment section.

5. The method of claim 4, wherein the web is supported by the supporting element through said web treatment section and during the entire web travel through the next downstream located drying apparatus.

6. The method of claim 2, wherein the web is passed supported by the supporting element at least from a drying apparatus preceding said web treatment section to the drying apparatus located downstream next to said web treatment section.

7. The method of claim 6, wherein the web is supported by the supporting element through said web treatment section and during the entire web travel through the next downstream located drying apparatus.

8. The method of claim 6, further comprising:

passing the web to a predryer cylinder group comprising at least one dryer cylinder and pressing the web against the cylinder by a single-wire support means;

supportedly passing the web to a treatment of the first side of the web, said web treatment comprising at least the application of a coating and the spreading/tensioning of the web; and passing the web to a like treatment of its second side and then by means of a single-wire support means to a postdryer group.

9. The method of claim 2, wherein the web is passed to at least one downstream located web treatment section supported by a continuous support element of an upstream preceding web treatment section.

10. The method of claim 9, further comprising:

passing the web to a predryer cylinder group comprising at least one dryer cylinder and pressing the web against the cylinder by a single-wire support means;

supportedly passing the web to a treatment of the first side of the web, said web treatment comprising at least the application of a coating and the spreading/tensioning of the web; and passing the web to a like treatment of its second side and then by means of a single-wire support means to a postdryer group.

11. The method of claim 2, further comprising:

passing the web to a predryer cylinder group comprising at least one dryer cylinder and pressing the web against the cylinder by a single-wire support means;

supportedly passing the web to a treatment of the first side of the web, said web treatment comprising at least the application of a coating and the spreading/tensioning of the web; and passing the web to a like treatment of its second side and then by means of a single-wire support means to a postdryer group.

12. The method of claim 1, wherein the web is passed supportedly and partially dried from an upstream preceding web treatment section to the next downstream located web treatment section.

13. The method of claim 12, wherein the web is passed to said web treatment section in a condition optimized with respect to at least one of the requirements of the paper grade being manufactured, the investment costs, the frequency of web breakages, the overall energy consumption of the process, desired paper quality, and a desired processing variable.

14. The method of claim 12, further comprising:

passing the web to a predryer cylinder group comprising at least one dryer cylinder and pressing the web against the cylinder by a single-wire support means;

supportedly passing the web to a treatment of the first side of the web, said web treatment comprising at least the application of a coating and the spreading/tensioning of the web; and passing the web to a like treatment of its second side and then by means of a single-wire support means to a postdryer group.

15. The method of claim 1, wherein the web is supportedly passed from an upstream preceding, web-wetting treatment section to the next downstream located web treatment section and the web is at least partially dried so that at least a portion of the moisture content of the web is evaporated.

16. The method of claim 15, further comprising:

passing the web to a predryer cylinder group comprising at least one dryer cylinder and pressing the web against the cylinder by a single-wire support means;

supportedly passing the web to a treatment of the first side of the web, said web treatment comprising at least the application of a coating and the spreading/tensioning of the web; and passing the web to a like treatment of its second side and then by means of a single-wire support means to a postdryer group.

17. The method of claim 1, wherein the web is supported by the supporting element against a member of the web treatment apparatus that applies the web-wetting agent to the surface of the web.

18. The method of claim 17, wherein the member is one of a film-transfer roll and blade coater.

19. The method of claim 1, wherein the web is at least partially dried by at least one of a microwave dryer, an air-impingement dryer, a contacting dryer, and a suction dryer, and wherein the web is supported by a member of a material suitable for resisting the impact of said drying apparatus.

20. The method of claim 19, wherein the supporting element is one of a belt, a surfaced belt, and a fabric that is impermeable to moisture.

21. The method of claim 19, wherein the supporting element is one of a wire, a fabric, a porous felt, and a porous or perforated belt that is permeable or absorbent to a liquid or gaseous medium.

22. The method of claim 1, wherein the supporting element is one of a belt, a surfaced belt, and a fabric that is impermeable to moisture.

23. The method of claim 1, wherein the supporting element is one of a wire, a fabric, a porous felt, and a porous or perforated belt that is permeable or absorbent to a liquid or gaseous medium.

24. The method of claim 1, wherein at least one surface of the web is coated with a coating which is transferred with the help of a movable member passing through an application nip or an application area.

25. The method of claim 24, wherein said application nip or application area is formed by a loading element comprising at least one of a roll, a belt and a sliding shoe.

26. The method of claim 25, wherein the web is pressed against the surface of at least one roll serving to form a nip and apply a coating.

27. The method of claim 25, wherein the web is pressed against the surface of at least one sliding shoe element serving to form a nip and allowing a coat-applying planar element to slide thereon.

28. The method of claim 25, wherein the web is supported in the film-transfer coater by means of a support belt that transfers a web treatment agent to the surface of the web.

29. The method of claim 1, wherein the web is supported in the preceeding section by air-jet support means, after which the web is passed onto a contacting support element for spreading the web, subjecting the same to measurement of process qualities or supportingly passing the web to subsequent web treatment sections.

30. The method of claim 1, wherein downstream of said dryer apparatus the web is supported by a plurality of successive support elements and the web is transferred supportedly or guided by web guidance means from one support element to the next support element in the succession.

31. The method of claim 30, wherein the web is passed from one support element to the next by a web spreading or tension-controlling means.

32. The method of claim 1, wherein downstream of said dryer apparatus the web is passed from one support element to the next by a web spreading or tension-controlling means.

33. The method of claim 1, wherein the web is pressed against the surface of at least one roll serving to form a nip and apply a coating.

34. The method of claim 1, wherein the web is pressed against the surface of at least one sliding shoe element serving to form a nip and allowing a coat-applying planar element to slide thereon.

35. The method of claim 1, wherein a first side of the web is supported by a movable continuous support element, while a coating is applied to the second side of the web.

36. The method of claim 35, wherein the coating is applied to the second side of the web using one of a spray-coating method, a jet-coating method, a blade/rod coater, and an applicator roll coater.

37. The method of claim 35, wherein the web is adhered to the supporting element by at least one of air impingement and suction.

38. The method of claim 1, wherein the web is adhered to the supporting element by at least one of air impingement and suction.

39. The method of claim 1, further comprising:

passing the web to a predryer cylinder group comprising at least one dryer cylinder and pressing the web against the cylinder by a single-wire support means;

supportedly passing the web to a treatment of the first side of the web, said web treatment comprising at least the application of a coating and the spreading/tensioning of the web; and passing the web to a like treatment of its second side and then by means of a single-wire support means to a postdryer group.

40. The method of claim 1, wherein downstream of said dryer apparatus the web is supported by a succession of support elements whose surface qualities are selected so that the adherence of the web at the cross-over point of said support elements is stronger to the next downstream receiving support element than to the preceding upstream delivering support element.

41. The method of claim 40, wherein the web is supported by elements in which the surface of the delivering support element is more hydrophilic than the surface of the receiving support element.

42. The method of claim 41, wherein the web treatment device is a film-transfer coater.

43. The method of claim 40, wherein the web is supported by elements in which the surface of the delivering support element is softer than the surface of the receiving support element.

44. The method of claim 43, wherein the web treatment device is a film-transfer coater.

45. The method of claim 40, wherein the web is supported by elements in which the surface of the delivering support element has a coarser texture than the surface of the receiving support element.

46. The method of claim 45, wherein the web treatment device is a film-transfer coater.

47. The method of claim 40, wherein the web treatment device is a film-transfer coater.

48. The method of claim 40, wherein the web is supported by a movable element comprised of one of a metal, a polymer, a glass fiber, a carbon fiber belt, a wire, a felt, a web, and a band.

49. The method of claim 40, wherein the web is supported in the film-transfer coater by means of a support belt that transfers a web treatment agent to the surface of the web.

50. The method of claim 1, wherein the web is supported by a movable element comprised of one of a metal, a polymer, a glass fiber, a carbon fiber belt, a wire, a felt, a web, and a band.

51. The method of claim 1, wherein the web is supported in the film-transfer coater by means of a support belt that transfers a web treatment agent to the surface of the web.

52. An apparatus for supportedly guiding a web during the post-processing of a web of paper or board, comprising:

at least one web treatment device for applying to at least one surface of the web a treatment agent that wets the web;

at least one device preceding said web treatment device; and a means for passing the web from said preceding device to at least one next downstream located web treatment device; and a single supporting element passing the web in a continuous and unbroken manner at least through and from said web treatment device to a next downstream located dryer.

53. The apparatus of claim 52, further comprising:

at least one dryer for drying the web prior to passing the web to said web treatment device, wherein said supporting element supports the web in a continuous and unbroken manner at least from said dryer preceding said web treatment device to said dryer located downstream next to said web treatment device.

54. The apparatus of claim 52, wherein said supporting element is a dryer wire of a paper or boardmaking machine.

55. The apparatus of claim 52, wherein said supporting element supports the web at least from a dryer preceding said web treatment device to said dryer located downstream next to said web treatment device.

56. The apparatus of claim 52, wherein said supporting element supports the web to at least one next downstream web treatment device from an upstream preceding web treatment device.

57. The apparatus of claim 56, wherein said supporting element supports the web through said web treatment device and during an entire web travel through the next downstream located dryer.

58. The apparatus of claim 52, further comprising at least one support element positioned to press the web against a member of the web treatment section that applies the treatment agent to the surface of the web.

59. The apparatus of claim 58, wherein the at least one support element is one of a film-transfer roll and blade coater.

60. The apparatus of claim 52, wherein the dryer comprises at least one of a microwave dryer, an air-impingement dryer, a contacting dryer, and a suction dryer, and wherein said supporting element is comprised of a material suitable for resisting the effects of said dryer.

61. The apparatus of claim 60, wherein said supporting element is one of a belt and surfaced belt or fabric that is impermeable to moisture.

62. The apparatus of claim 60, wherein said supporting element is one of a fabric, porous felt, and a porous or perforated belt that is permeable or absorbent to a liquid or gaseous medium.

63. The apparatus of claim 52, wherein said supporting element is one of a belt and surfaced belt or fabric that is impermeable to moisture.

64. The apparatus of claim 52, wherein said supporting element is one of a fabric, porous felt, and a porous or perforated belt that is permeable or absorbent to a liquid or gaseous medium.

65. The apparatus of claim 52, further comprising at least one movable element capable of forming at least one application nip or area, in which nip or area at least one surface of the web is coated with a coating transferred with the help of said movable member passing through said application nip or area.

66. The apparatus of claim 65, wherein said application nip or area is comprised of a loading element.

67. The apparatus of claim 66, wherein said loading element comprises one of a roll, a belt, and a sliding shoe.

68. The apparatus of claim 52, further comprising downstream of said dryer a web guidance means and a plurality of successive support elements supporting the web to transfer the web supportedly or guided by the web guidance means from one support element to the next support element in the succession.

69. The apparatus of claim 52, further comprising a movable continuous support element and a means for supportedly pressing a first side of the web against the movable continuous support element, and further comprising means for applying a coating to the second side of the web.

70. The apparatus of claim 69, wherein the means for applying a coating to the second side of the web employs one of a spray-coating method, a jet-coating method, a blade/rod coater and an applicator roll coater.

71. The apparatus of claim 69, further comprising at least one of air-impingement and suction means to cause the web to adhere to the supporting element.

72. The apparatus of claim 52, further comprising at least one of air-impingement and suction means to cause the web to adhere to the supporting element.

73. The apparatus of claim 52, wherein a surface of the supporting element is patterned with a desired surface texture to make a desired surface or base coating pattern on the web side to be treated.

74. The apparatus of claim 52, further comprising a succession of support elements to support the web downstream of said dryer said support elements having their surface qualities selected so as to make adherence of the web at a cross-over point of said support elements stronger to a next downstream receiving support element than to a preceding upstream delivering support element.

75. The apparatus of claim 74, wherein a surface of a delivering support element is more hydrophilic than a surface of a receiving support element.

76. The apparatus of claim 75, wherein said web treatment device is a film-transfer coater.

77. The apparatus of claim 74, wherein a surface of a delivering support element has a coarser texture than that of a surface of a receiving support element.

78. The apparatus of claim 74, wherein the surface of a delivering support element is softer than the surface of a receiving support element.

79. The apparatus of claim 78, wherein said web treatment device is a film-transfer coater.

80. The apparatus of claim 74, wherein said web treatment device is a film-transfer coater.

81. The apparatus of claim 74, further comprising a movable element to support the web, comprised of one of a metal, a polymer, a glass fiber, a carbon fiber belt, a wire, a felt, a web, and a band.

82. The apparatus of claim 52, further comprising a movable element to support the web, comprised of one of a metal, a polymer, a glass fiber, a carbon fiber belt, a wire, a felt, a web, and a band.

* * * * *